US010835040B1

(12) United States Patent
El-Sayed et al.

(10) Patent No.: US 10,835,040 B1
(45) Date of Patent: Nov. 17, 2020

(54) APPLIANCE STORAGE ASSEMBLY

(71) Applicant: WHIRLPOOL CORPORATION, Benton Harbor, MI (US)

(72) Inventors: Kamil Musa El-Sayed, Wroclaw (PL); Bartosz Daniel Stawczyk, Wroclaw (PL); Atishkumar S. Dhage, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/677,144

(22) Filed: Nov. 7, 2019

(51) Int. Cl.

| | |
|---|---|
| ***A47B 96/04*** | (2006.01) |
| ***A47B 88/975*** | (2017.01) |
| ***A47B 88/994*** | (2017.01) |
| ***F25D 23/06*** | (2006.01) |
| ***A47B 57/58*** | (2006.01) |

(52) U.S. Cl.
CPC ..... *A47B 88/975* (2017.01); *A47B 57/583* (2013.01); *A47B 88/994* (2017.01); *F25D 23/069* (2013.01)

(58) Field of Classification Search
CPC ... F25D 23/069; A47B 88/975; A47B 88/994; A47B 57/583; A47B 57/588; A47B 65/15; A47B 96/04; A47F 5/005; A47F 5/132; A47F 7/144
See application file for complete search history.

(56) References Cited

U.S. PATENT DOCUMENTS

| | | | | |
|---|---|---|---|---|
| 3,067,903 | A | 12/1962 | Jones, Jr. | |
| 4,488,653 | A | 12/1984 | Belokin | |
| 4,889,253 | A * | 12/1989 | Schmulian | A45C 13/02 220/551 |
| D329,380 | S * | 9/1992 | Hazlett | D9/434 |
| 5,992,959 | A * | 11/1999 | Kawamoto | G07G 1/0027 312/348.3 |
| 7,992,726 | B2 | 8/2011 | Goehring | |
| 8,317,040 | B2 | 11/2012 | Lanning | |
| 8,833,875 | B2 | 9/2014 | Arslankiray et al. | |
| 8,960,824 | B2 | 2/2015 | Wilcox et al. | |
| 9,261,304 | B2 | 2/2016 | Tunzi | |
| 2009/0255891 | A1* | 10/2009 | Lanning | A47B 88/994 211/183 |
| 2011/0156564 | A1 | 6/2011 | Park | |
| 2014/0210331 | A1* | 7/2014 | Tunzi | F25D 25/00 312/404 |
| 2018/0116067 | A1* | 4/2018 | Good | A47B 88/975 |

FOREIGN PATENT DOCUMENTS

| | | | | |
|---|---|---|---|---|
| DE | 202010008566 | U1 * | 12/2011 | A47B 88/90 |
| DE | 202017106273 | U1 * | 10/2017 | A47B 88/975 |

* cited by examiner

*Primary Examiner* — Matthew W Ing
(74) *Attorney, Agent, or Firm* — Price Heneveld LLP

(57) ABSTRACT

An appliance storage assembly includes a storage feature that includes a base and a plurality of walls that extend from the base. The base and the plurality of walls define a storage cavity. A rail assembly includes a rail and a rail slide. The rail slide is coupled to the storage feature and enables the storage feature to move along a length of the rail. A divider includes an upper retaining member and a lower retaining member spaced-apart from one another by at least one connecting member. The upper retaining member defines upper grooves and the lower retaining member defines corresponding lower grooves. A magnet is coupled to the lower retaining member and selectively engages the base of the storage feature.

20 Claims, 4 Drawing Sheets

APPLIANCE STORAGE ASSEMBLY

BACKGROUND OF THE DISCLOSURE

The present disclosure generally relates to an appliance storage assembly, and more specifically, to an organizer for a storage assembly.

SUMMARY OF THE DISCLOSURE

According to one aspect of the present disclosure, an appliance storage assembly includes a storage feature that includes a base and a plurality of walls that extend from the base. The base and the plurality of walls define a storage cavity. A rail assembly includes a rail and a rail slide. The rail slide is coupled to the storage feature and enables the storage feature to move along a length of the rail. A divider includes an upper retaining member and a lower retaining member spaced-apart from one another by at least one connecting member. The upper retaining member defines upper grooves and the lower retaining member defines corresponding lower grooves. A magnet is coupled to the lower retaining member and selectively engages the base of the storage feature.

According to another aspect of the present disclosure, a storage assembly for an appliance includes a storage feature that has a plurality of walls that extend vertically from a metallic base. A rail assembly includes a rail slide slidably engaged with a rail. The rail slide is coupled to the storage feature. A divider includes an upper retaining member that defines a plurality of upper grooves and a lower retaining member that defines a plurality of lower grooves. At least one magnet is disposed within at least one receiving cavity defined in a lower surface of the lower retaining member and selectively engages the metallic base. A lower surface of the at least one magnet is flush with a lower surface of the lower retaining member.

According to yet another aspect of the present disclosure, an organizer for a storage assembly includes a divider that has an upper retaining member that defines a first upper groove and a second upper groove and a lower retaining member that defines a first lower groove and a second lower groove. The first and second upper grooves vertically align with the first and second lower grooves to define first and second receiving spaces. A magnet is coupled to the lower retaining member for selectively engaging the divider with the base.

These and other features, advantages, and objects of the present disclosure will be further understood and appreciated by those skilled in the art by reference to the following specification, claims, and appended drawings.

Figure 1:
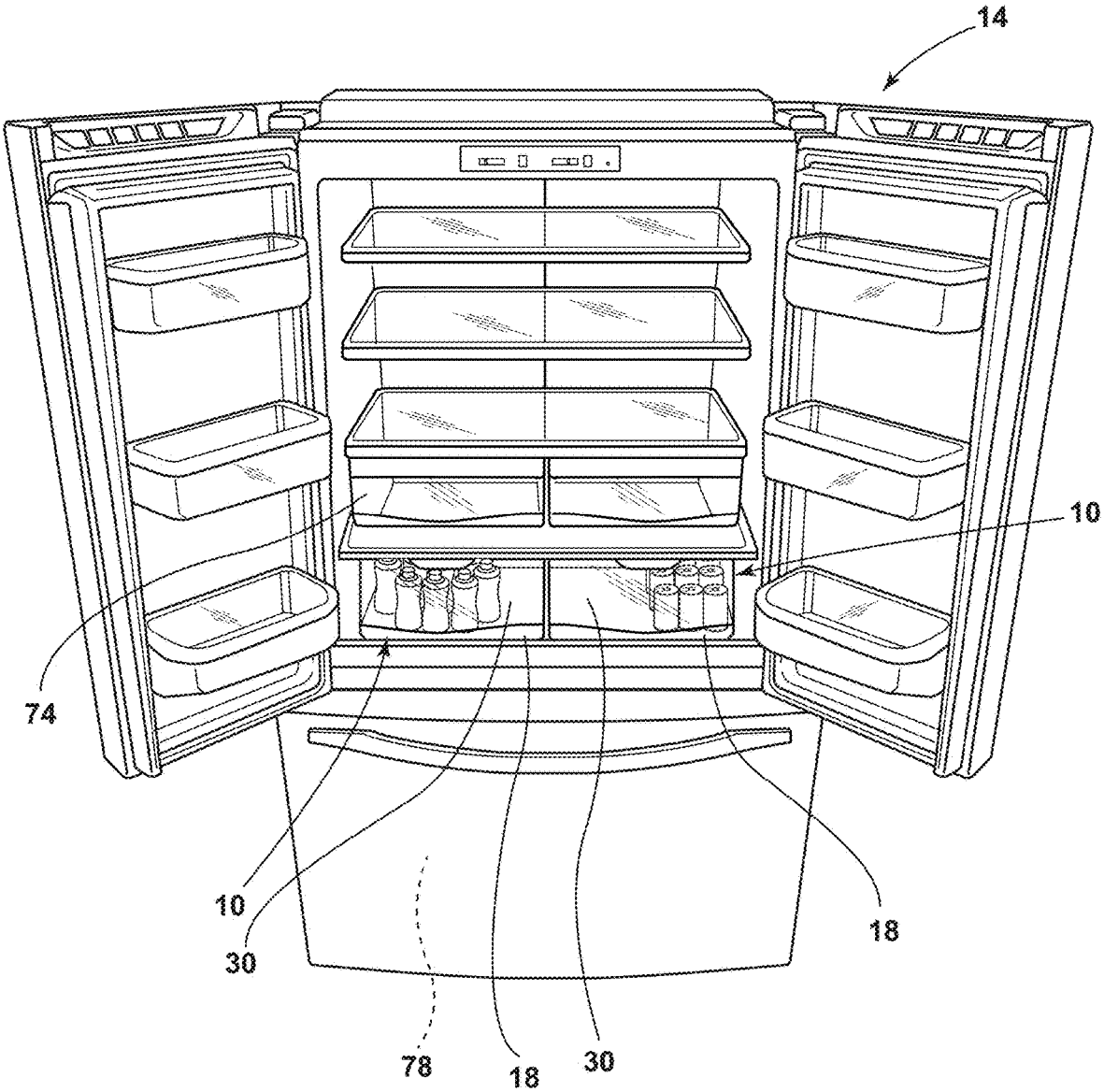
FIG. 1 is a front perspective view of an appliance that has a storage assembly, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to an appliance storage assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-7, reference numeral 10 generally designates a storage assembly for an appliance 14 that includes a storage feature 18. The storage feature 18 includes a base 22 and a plurality of walls 26 that extend from the base 22. The base 22 and the plurality of walls 26 define a storage cavity 30. A rail assembly 34 includes a rail 38 and a rail slide 42. The rail slide 42 is coupled to the storage feature 18 and enables the storage feature 18 to move along a length of the rail 38. A divider 46 includes an upper retaining member 50 and a lower retaining member 54 spaced-apart from one another by a connecting member 58. The upper retaining member 50 defines upper grooves 62 and the lower retaining member 54 defines corresponding lower grooves 66. A magnet 70 is coupled to the lower retaining member 54 and selectively engages the base 22 of the storage feature 18.

Referring to FIG. 1, the appliance 14 is illustrated as a refrigerator that defines refrigerator and freezer compartments 74, 78. The appliance 14 may include one or more storage assemblies 10 within the refrigerator and/or freezer compartments 74, 78. While illustrated as a bottom-mount French door refrigerator, the appliance 14 may be a bottom-refrigerator, a top-mount refrigerator, a side-by-side refrigerator, a four-door French door refrigerator, and/or a five-door French door refrigerator. Further, the present disclosure is not limited to refrigerators. For example, the appliance 14 may be, a freezer, a cooler, a vacuum insulated structure, a storage structure, and/or other similar appliances and fixtures within household and commercial settings. The storage assembly 10 includes the storage feature 18 for storing a variety of goods. The storage feature 18 may be configured as a drawer, a bin, a shelf, or other similar storage structures.

Figure 2:
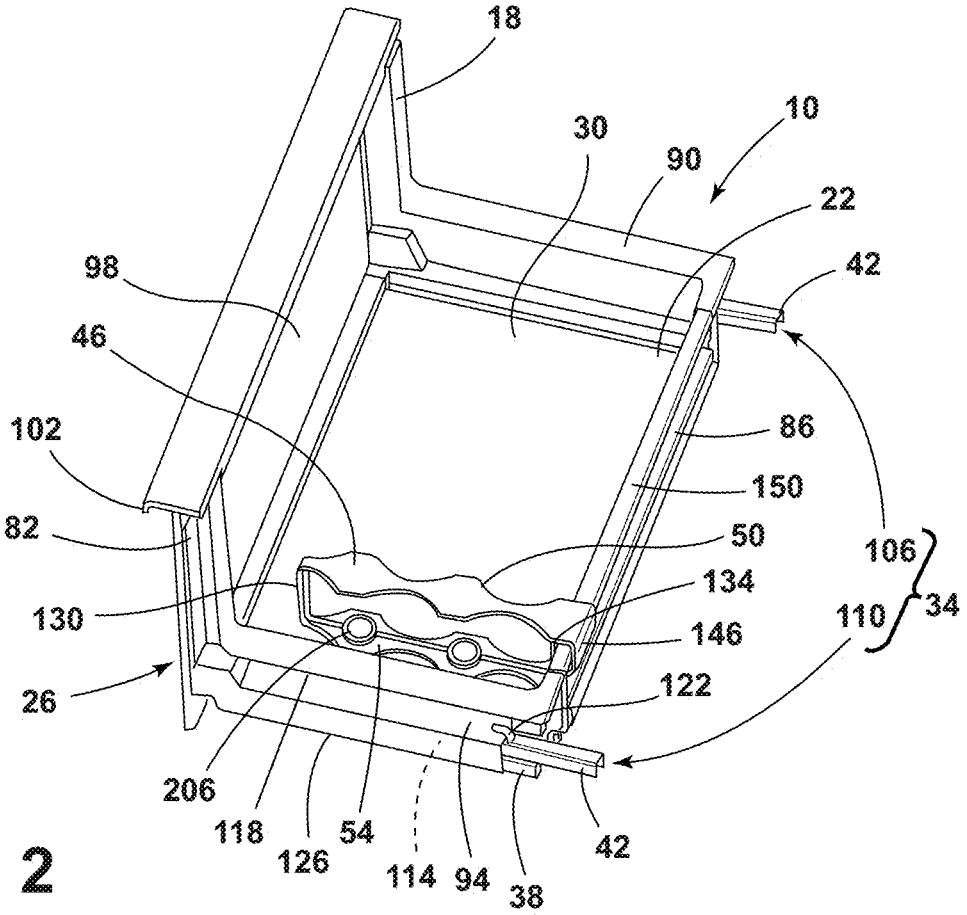
FIG. 2 is a side perspective view of a divider positioned within an appliance storage feature, according to the present disclosure.

Referring to FIGS. 1 and 2, the storage assembly 10 may include the rail assembly 34. The rail 38 may be coupled to the appliance 14, and the rail slide 42 may be coupled to the storage feature 18. The rail slide 42 may slidably engage the rail 38. In this way, the rail slide 42 may be configured to translate the storage feature 18 fore and aft relative to the rail 38. In various examples, the storage feature 18 may translate between stowed and deployed positions. Stated differently, the rail slide 42 enables the storage feature 18 to move along a length of the rail 38. In the stowed position, as illustrated in FIG. 1, food goods within the storage feature 18 may not be accessible by a consumer, and in the deployed position the food goods in the storage feature 18 may be accessible by the consumer.

Referring to FIG. 2, the storage assembly 10 may include the base 22 with the plurality of walls 26 that extend vertically from the base 22. The base 22 and the plurality of walls 26 may define the storage cavity 30 therein. According to various aspects, the plurality of walls 26 may include a front wall 82, a rear wall 86, and opposing sidewalls 90, 94 that extend therebetween. In this way, the storage feature 18 may have a substantially rectangular construction, however, it is contemplated that any practicable configuration of the storage feature 18 may be used in the appliance 14.

According to various aspects, the rear wall 86 and the opposing sidewalls 90, 94 may have a substantially similar height relative to the base 22. The front wall 82 may have a greater height relative to the base 22 than the rear wall 86 and/or the opposing sidewalls 90, 94. The greater height of the front wall 82 may improve the aesthetics of the storage feature 18 within the appliance 14. In a non-limiting example, the front wall 82 may include a substantially transparent panel 98 that allows the consumer to view the storage cavity 30 of the storage feature 18, without moving the storage feature 18 to the deployed position. Additionally or alternatively, the front wall 82 may include a handle 102 for the consumer to translate the storage feature 18 fore and aft along the length of the rail 38. The front wall 82 may extend beyond the base 22 in width and/or height. In such configurations, the front wall 82 may substantially conceal the rail assembly 34 (e.g., extend below the base) from view when the storage feature 18 is in the stowed position.

In various examples, the storage feature 18 includes a first rail assembly 106 and a second rail assembly 110 coupled to the opposing sidewalls 90, 94. Each of the first and second rail assemblies 106, 110 may include the rail 38 and the rail slide 42. In various examples, the storage feature defines channels 114 proximate outer surfaces 118 of the opposing sidewalls 90, 94 for housing the first and second rail assemblies 106, 110. The channels 114 may substantially obscure the first and second rail assemblies 106, 110 from the view of the consumer when the storage feature 18 is in the stowed position. In various examples, the rail slides 42 may remain within the channels 114 as the storage feature 18 translates fore and aft along the length of the rail 38. In such examples, the rail slides 42 may each include a clip 122 for engaging at least one channel wall 126 of the respective channel 114. In this way, the clip 122 may at least partially secure and/or retain the rail slides 42 to the storage feature 18.

Figure 3:
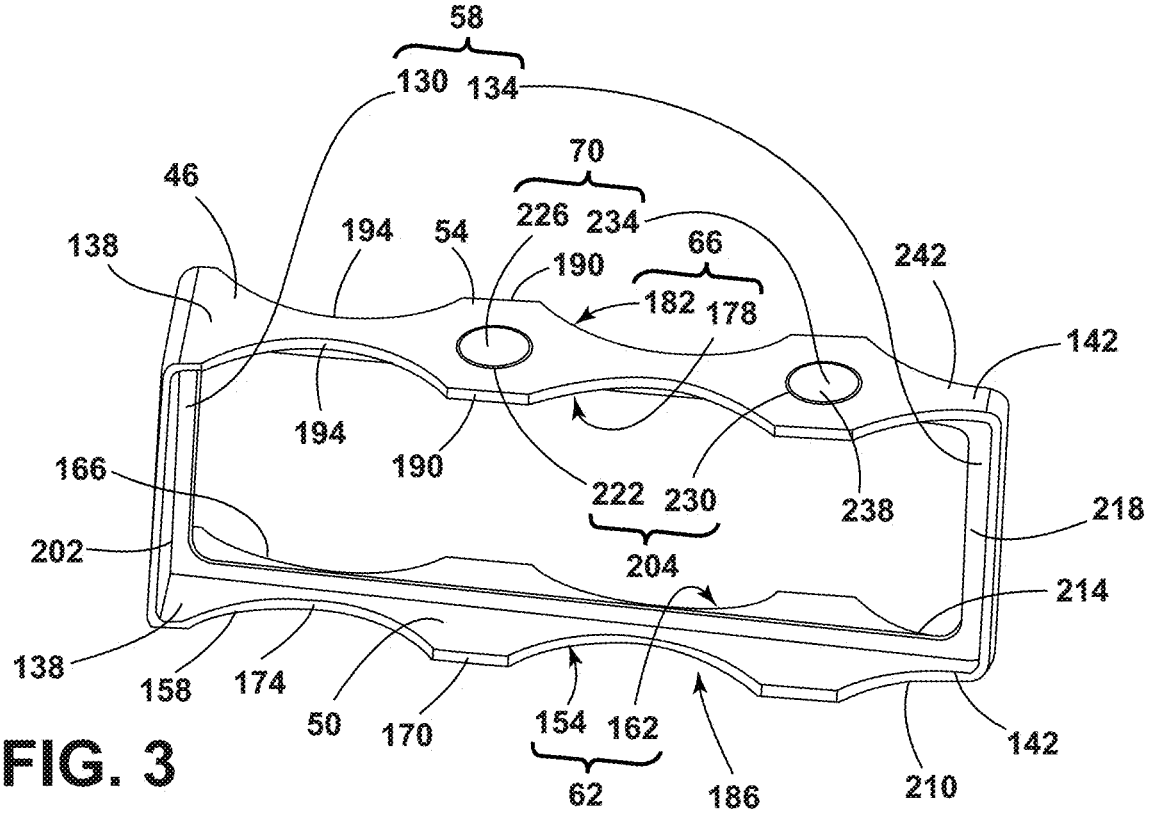
FIG. 3 is a bottom perspective view of the divider of FIG. 2.

Referring to FIGS. 2 and 3, the divider 46 may selectively engage the base 22 of the storage feature 18. The divider 46 may include upper and lower retaining members 50, 54 spaced-apart from one another by the connecting member 58. As illustrated in FIGS. 2 and 3, the upper and lower retaining members 50, 54 are coupled together via first and second connecting members 130, 134 that extend between first and second ends 138, 142 of the upper and lower retaining members 50, 54. In this way, the first and second connecting members 130, 134 may be spaced-apart from one another. While the divider 46 is illustrated with the first and second connecting members 130, 134, it is contemplated that a single connecting member 58 may extend between the upper and lower retaining members 50, 54, without departing from the teachings herein. Further, it is contemplated that the first and second connecting members 130, 134 may be coupled to any practicable location on the upper and lower retaining members 50, 54.

As illustrated in FIG. 2, the upper retaining member 50 includes a hook extension 146 for engaging a top edge 150 of the rear wall 86. In this way, one of the first and second connecting members 130, 134 may be disposed adjacent to the rear wall 86. The hook extension 146 may extend over the top edge 150 and retain the divider 46 adjacent to the rear wall 86. The hook extension 146 may be configured to engage the opposing sidewalls 90, 94 to retain the divider 46 adjacent to at least one of the opposing sidewalls 90, 94. The hook extension 146 may provide additional stability to the divider 46 when disposed within the storage feature 18.

Referring still to FIGS. 2 and 3, the upper retaining member 50 may define multiple upper grooves 62. In various examples, the upper retaining member 50 may define first upper grooves 154 on a first side 158 of the divider 46 and second upper grooves 162 on a second side 166 of the divider 46. The first and second upper grooves 154, 162 may substantially align with one another. In this way, an apex 170 of the first upper grooves 154 may align with the apex 170 of a corresponding second upper groove 162. The apexes 170 of the first and second upper grooves 154, 162 may at least partially define a first width of the divider 46. Additionally or alternatively, the vertex 174 of each of the first upper grooves 154 may align with a vertex 174 of a corresponding second upper groove 162. In this way, the vertices 174 of the first and second upper grooves 154, 162 may at least partially define a second width of the divider 46. According to various aspects, the first and second upper grooves 154, 162 may each be substantially parabolic for engaging food goods that have differing diameters. Alternatively, the apexes 170 may be substantially linear, such that adjacent upper grooves 62 may be spaced-apart from one another by a linear edge. The apexes 170 between adjacent upper grooves 62 may be rounded or curved. In such examples, the first and second sides 158, 166 of the upper retaining member 50 may be substantially sinusoidal.

The lower retaining member 54 may be configured in a similar manner as the upper retaining member 50. The lower retaining member 54 may include first lower grooves 178 defined on the first side 158 of the divider 46 and second lower grooves 182 defined on the second side 166 of the divider 46. According to various aspects, the upper grooves 62 may correspond with the lower grooves 66. In this way, the first upper grooves 154 may align with the first lower grooves 178, and the second upper grooves 162 may align with the second lower grooves 182. In various examples, the first and second upper grooves 154, 162 may vertically align with the first and second lower grooves 178, 182 to define multiple receiving spaces 186 for accommodating the food goods. The rounded upper and lower grooves 62, 66 may be advantageous for accommodating food goods that are different sizes and/or diameters. The food goods may be, for example, fruits, vegetables, cans, bottles, substantially cylindrical goods, frusto-conical shaped goods, and/or a combination thereof.

According to various aspects, an apex 190 of each of the first lower grooves 178 may align with the apex 190 of a corresponding second lower groove 182. Additionally or alternatively, a vertex 194 of each of the first lower grooves 178 may align with the vertex 194 of a corresponding second lower groove 182. In this way, the apexes 190 may partially define the first width of the divider 46 and the vertices 194 may at least partially define the second width of the divider 46. Stated differently, the divider 46 may define the first width between corresponding apexes 190 and the second width between adjacent apexes 190. In various examples, the second width defined by the vertices 174, 194 may be less than the first width defined by the apexes 170, 190. Stated differently, the first width of the divider 46 defined by the apexes 170, 190 of the upper and lower grooves 62, 66 may be greater than the second width defined by the vertices 174, 194 of the upper and lower grooves 62, 66. Similar to the upper retaining member 50, the first and second sides 158, 166 of the lower retaining member 54 may be substantially sinusoidal in shape, or alternatively, adjacent lower grooves 66 may be spaced-apart from one another by a substantially linear edge.

Referring still to FIGS. 2 and 3, the divider 46 may include the first and second connecting members 130, 134 that extend between the first and second ends 138, 142 of the divider 46. Depending on the configuration of the upper and lower grooves 62, 66, the first and second connecting members 130, 134 may have substantially similar configurations, or alternatively, different configurations. As illustrated in FIGS. 2 and 3, the first connecting member 130 may have a greater width than the second connecting member 134. The first connecting member 130 may correspond with the apexes 170, 190 and the second connecting member 134 may correspond with the vertices 174, 194 of the upper and lower grooves 62, 66. In various examples, the divider 46 may have at least one upper and lower groove 62, 66 that differs from the others. The upper and lower grooves 62, 66 may define different end grooves 210, 214. At least one of the upper and/or lower grooves 62, 66 may define the parabolic shape. In various examples, the end grooves 210, 214 may define a portion of the parabolic shape. In this way, the end grooves 210, 214 may extend between the vertices 174, 194 and a single corresponding apex 170, 190.

The second connecting member 134 may extend between the second ends 142 of the upper and lower retaining members 50, 54 proximate the end grooves 210, 214. As the second connecting member 134 extends between the end grooves 210, 214 proximate the vertices 174, 194, the second connecting member 134 may have a width substantially similar to the second width of the divider 46. The first connecting member 130 that extends between the first ends 138 of the upper and lower retaining members 50, 54 proximate the apexes 170, 190 of the upper and lower grooves 62, 66 may result in the first connecting member 130 having a width similar to the first width of the divider 46. Additionally or alternatively, the first and second connecting members 130, 134 may have substantially similar heights. Alternatively, the first connecting member 130 may have a height greater than the height of the second connecting member 134. This configuration may provide for an upper retaining member 50 having an oblique-orientation relative to the lower retaining member 54. The oblique-orientation of the upper retaining members 50 may be advantageous for receiving food goods of differing heights within the receiving spaces 186. Stated differently, the first connecting member 130 may be substantially larger than the second connecting member 134.

According to various aspects, the divider 46 may include an internal flange 218 that extends from the inner surface 202 of the divider 46. The internal flange 218 may extend around the divider 46 to connect at least one of the upper and lower retaining members 50, 54 with the first and/or second connecting members 130, 134. The internal flange 218 may extend from the inner surface 202 of the divider 46 into the space defined between the upper and lower retaining members 50, 54 and the first and second connecting members 130, 134. The internal flange 218 may support the connection between at least one of the upper and lower retaining members 50, 54 with the first and/or second connecting members 130, 134. Additionally or alternatively, the internal flange 218 may increase the strength and/or rigidity of the divider 46.

Referring still to FIGS. 2 and 3, the lower retaining member 54 may define at least one receiving cavity 204. The receiving cavity 204 may be offset from an inner surface 202 of the lower retaining member 54. In this way, a closed end 206 of the receiving cavity 204 may be spaced-apart from the inner surface 202 of the lower retaining member 54, such that the closed end 206 protrudes into the space defined between the upper and lower retaining members 50, 54.

The divider 46 may include the magnet 70. As illustrated, the divider 46 includes a first receiving cavity 222 that houses a first magnet 226 and a second receiving cavity 230 that houses a second magnet 234. The first and second receiving cavities 222, 230 may be spaced-apart from one another and defined in portions of the lower retaining member 54 that define the second width. The greater second width provides more surface area to accommodate and support the first and second magnets 226, 234. The first and second magnets 226, 234 may be coupled to the lower retaining member 54 by, for example, adhesives, interlocking fits, and/or force fits. In this way, the first and second magnets 226, 234 can be retained within the first and second receiving cavities 222, 230. As illustrated in FIGS. 2 and 3, the first and second magnets 226, 234 and the first and second receiving cavities 222, 230 are substantially circular in cross-section; however, it is contemplated that the first and second magnets 226, 234 and/or the first and second receiving cavities 222, 230 may be any practicable shape.

The first and second magnets 226, 234 may be any type of magnet that engages the base 22. In a non-limiting example, at least one of the first and second magnets 226, 234 may be neodymium magnet discs. In such examples, the first and second magnets 226, 234 may have any practicable grade, such as, for example Grade N45. Additionally or alternatively, in non-limiting examples, the first and second magnets 226, 234 may have a diameter of about 15 mm and a thickness of about 2 mm. However, it is contemplated that the first and second magnets 226, 234 may be of any practicable size. According to various aspects, the first and second magnets 226, 234 may be entirely disposed within the first and second receiving cavities 222, 230. In this way, lower surfaces 238 of the first and second magnets 226, 234 may be substantially flush with a lower surface 242 of the lower retaining member 54. The divider 46 may have a substantially flat surface for engaging the base 22 of the storage feature 18.

According to various aspects, the divider 46 may be constructed of an injected plastic material. In non-limiting examples, the divider 46 may be constructed of a thermoplastic polymer, such as acrylonitrile butadiene styrene. Additionally or alternatively, the thermoplastic material may enclose the first and second magnets 226, 234 within the lower retaining member 54. In this way, the first and second magnets 226, 234 may engage the base 22 through the thermoplastic material. The thermoplastic material can act as a coating over the first and second magnets 226, 234, thereby enclosing the first and second magnets 226, 234 in the first and second receiving cavities 222, 230. However, it is contemplated that the first and second magnets 226, 234 may directly engage the base 22 without a thermoplastic material therebetween.

Figure 4:
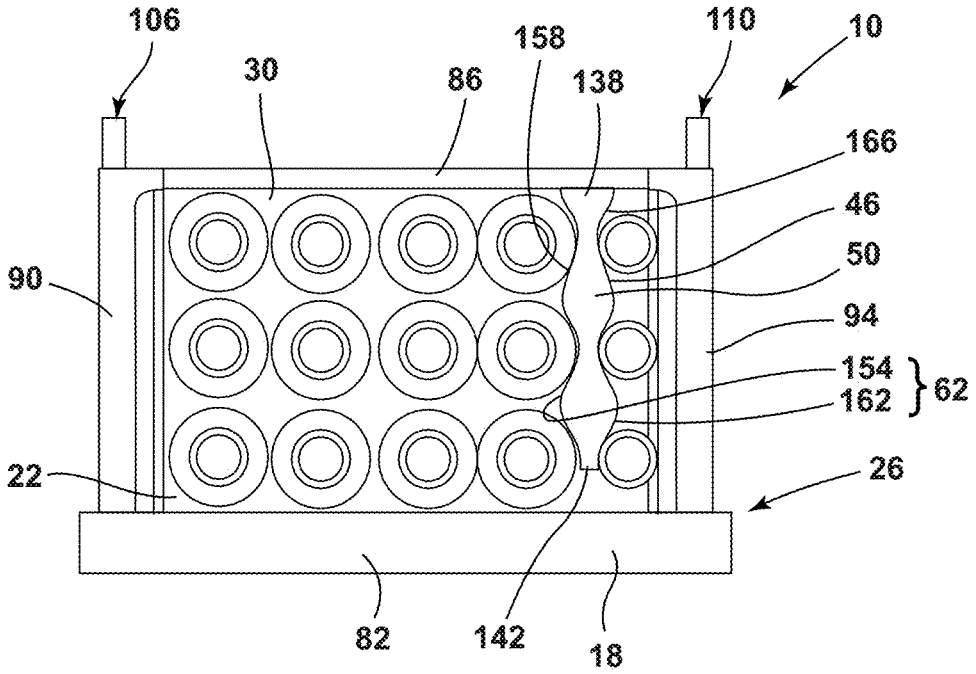
FIG. 4 is a top plan view of a divider organizing food goods within an appliance storage feature, according to the present disclosure.

Referring to FIGS. 3 and 4, the divider 46 may magnetically engage the base 22 of the storage feature 18. In this way, the divider 46 may selectively engage the base 22, such that the divider 46 may be positioned in different locations on the base 22. In various examples, the base 22 may be constructed of materials that have magnetic properties. In non-limiting examples, the base 22 may be constructed to include, for example, metals, metal alloys and/or combinations thereof. The base 22 may be constructed of ferromagnetic materials. Such constructions of the base 22 may be advantageous for retaining the divider 46 in selected positions within the storage feature 18. The base 22 may be metallic. The base 22 may include thermoplastic materials. In such examples, the storage feature 18 may be injected with metallic materials and/or covered in a metallic film layer. The thermoplastic materials may include, for example, polystyrene, polypropylene and talc, and/or general-purpose polystyrene (e.g., GPPS), combinations thereof, and/or any other practicable material.

Figure 5:
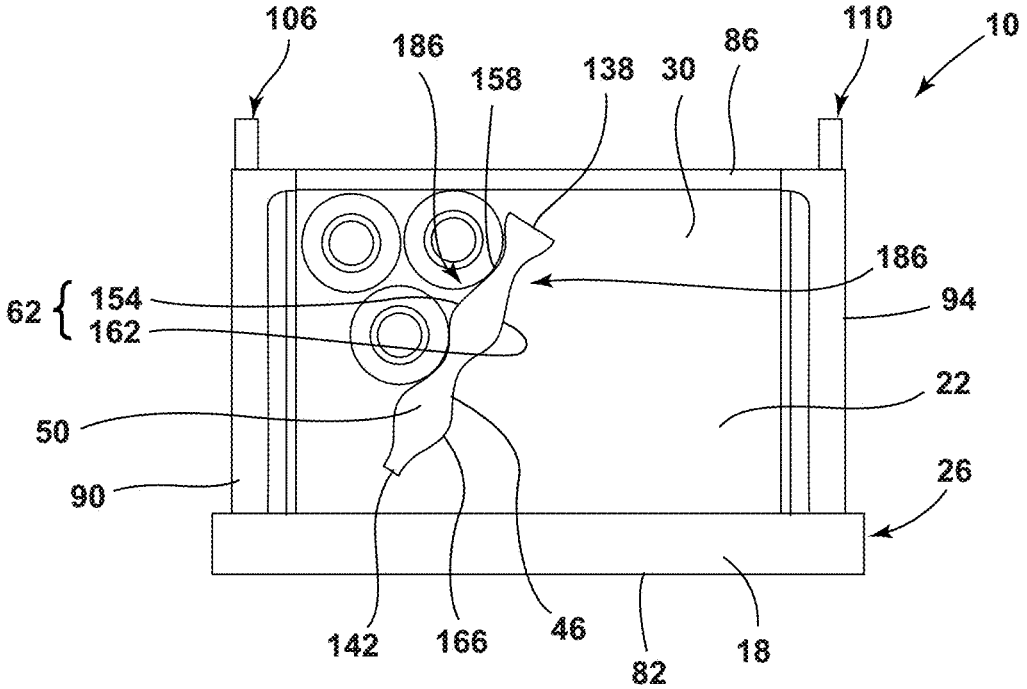
FIG. 5 is a top plan view of a divider retaining food goods within an appliance storage feature, according to the present disclosure.

Referring to FIGS. 4 and 5, the magnetic engagement between the divider 46 and the base 22 may allow for the divider 46 to be positioned at any practicable position and/or angle within the storage cavity 30 of the storage feature 18. In a non-limiting example, as illustrated in FIG. 4, the divider 46 can be positioned parallel to the opposing sidewalls 90, 94. In this example, the divider 46 retains the food goods in receiving spaces 186 on both the first and second sides 158, 166 of the divider 46. As illustrated in FIG. 4, some of the food goods are retained between the divider 46 and one of the opposing sidewalls 90, 94 and other food goods are retained between the divider 46 and other food goods within the storage cavity 30. In this way, the food goods can be substantially held in position as the storage feature 18 translates along the rail assemblies 34. This may be advantageous to reduce movement of the food good in the storage feature 18.

In another non-limiting example, as illustrated in FIG. 5, the divider 46 can be positioned at an angle relative to the rear wall 86 and the opposing sidewalls 90, 94. In other words, the divider 46 is arranged in a diagonal arrangement along the base 22. The food goods in the illustrated non-limiting example of FIG. 5 are retained between the divider 46 and a corner defined between the rear wall 86 and one of the opposing sidewalls 90, 94. In various examples, the magnetic engagement between the divider 46 and the base 22 can retain the divider 46 in the selected position as the storage feature 18 translates fore and aft along the first and second rail assemblies 106, 110. In this way, the divider 46 may or may not abut any of the plurality of walls 26 of the storage feature 18 and operates to retain the food goods within the selected position.

Figure 6:
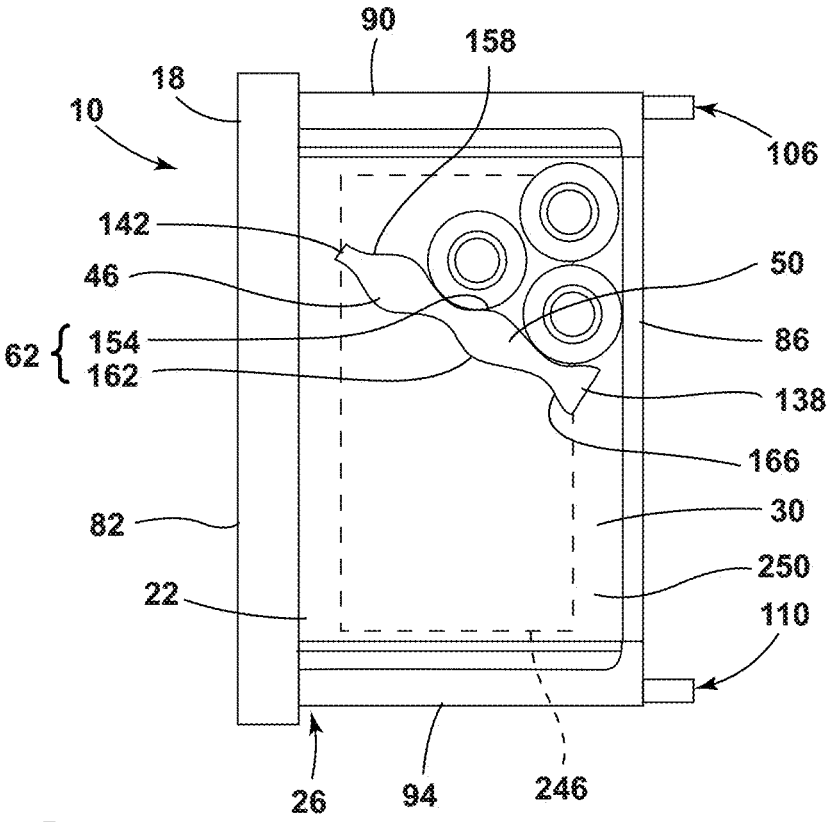
FIG. 6 is a top plan view of a divider engaging a magnetic member of an appliance storage feature, according to the present disclosure.
Figure 7:
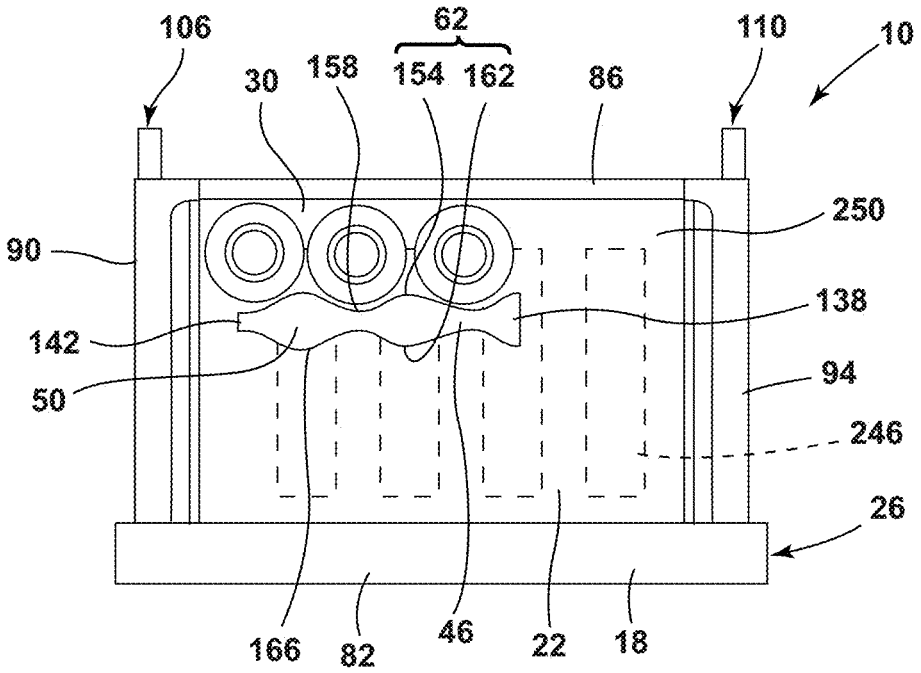
FIG. 7 is a top plan view of a divider engaging a magnetic member of an appliance storage feature to retain food goods, according to the present disclosure.

Referring to FIGS. 6 and 7, the base 22 may include a magnetic member 246. The magnetic member 246 may include ferromagnetic materials and/or additional magnets. The magnetic member 246 may be disposed on, or alternatively, be integrally formed with the base 22. In various aspects, the base 22 may provide the magnetic properties to engage the divider 46, and in other aspects the magnetic member 246 may provide the magnetic properties.

As illustrated in FIG. 6, the magnetic member 246 may be a single member that extends across the base 22. In another non-limiting example, as illustrated in FIG. 7, the magnetic member 246 may include a plurality of magnetic strips disposed along the base 22. The magnetic strips may abut one another, or alternatively, may be spaced-apart from one another. According to various aspects, the magnetic member 246 may be a magnetic film disposed on an upper surface 250 of the base 22. The magnetic member 246 may be any practicable material that magnetically engages the first and second magnets 226, 234 (FIG. 3) of the divider 46. The magnetic member 246 may be disposed across the entire upper surface 250 of the base 22. This configuration may be advantageous for increasing the number of arrangements of the divider 46 on the base 22. However, it is contemplated that the magnetic member 246 may not extend across the entire upper surface 250. In such examples, portions of the base 22 may be configured to not magnetically engage the divider 46. In examples where the base 22 includes the magnetic member 246, it is contemplated that the divider 46 may include steel discs in place of, and/or in addition to, the first and second magnets 226, 234 (FIG. 3). The magnetic member 246 may magnetically engage the steel discs.

Referring to FIGS. 1-7, the divider 46 can magnetically engage the base 22 to retain the divider 46 in the selected position on the base 22. The consumer can place the divider 46 at any practicable position and/or angle within the storage cavity 30. In this way, the divider 46 can be retained within the selected position by the magnetic engagement with the base 22. Moreover, the magnetic engagement can provide for innumerable arrangements of the divider 46 for retaining and/or organizing the food goods within the storage feature 18. The divider 46 can provide flexibility in organizing the food goods within the storage feature 18. Moreover, the divider 46 can include additional magnets 70 to magnetically engage two or more dividers 46 with one another. One or both of the first and second connecting members 130, 134 may include respective magnets 70, which can be configured to engage one another. Additionally or alternatively, one or both of the first and second connecting members 130, 134 may include the magnetic member 246 to engage the magnet 70 of another divider 46. Magnetically engageable dividers 46 may be advantageous for additional flexibility in organizing the food goods. Further, the dividers 46 may align with one another to extend across a larger storage feature 18 and organize a larger quantity of the food goods.

According to various aspects, the base 22 may be constructed of thermally conductive materials that act as a heatsink, which results in energy transfer from the food goods disposed within the storage cavity 30 to the thermally conductive material. In this way, the base 22 may transfer energy (e.g., heat) away from the food goods. Stated differently, the base 22 may promote cooling within the storage cavity 30. In non-limiting examples, the base 22 may be constructed of metallic materials, such as metals, metal alloys, and/or combinations thereof. In additional or alternative non-limiting examples, the base 22 may be constructed of carbon-based materials, such as silicon carbide, graphite, other similar materials, and/or combinations thereof. It is contemplated that the base 22 may be constructed of materials that have a thermal conductivity of at least 50 W/mK, at least 75 W/mK, at least 100 W/mK, at least 150 W/mK, at least 200 W/mK, at least 250 W/mK, at least 300 W/mK, at least 350 W/mK, at least 400 W/mK, at least 450 W/mK, and/or any combination thereof. In a non-limiting example, the base 22 may include one or more materials having a thermal conductivity in a range of from about 150 W/mK to about 400 W/mK. The thermal conductivity of the materials that construct the base 22 act as a heatsink to transfer thermal energy away from the food goods disposed within the storage cavity 30.

Use of the present device may provide for a variety of advantages. For example, the divider 46 may magnetically and/or selectively engage the base 22 to provide various arrangements of the food goods stored in the storage feature 18. Further, the divider 46 can be positioned in any practicable position, angle, and/or direction within the storage cavity 30 to retain the food goods in the selected position. Also, the magnetic engagement between the divider 46 and the base 22 may retain the divider 46 in the selected position without support from at least one of the plurality of walls 26. Moreover, the upper and lower grooves 62, 66 may accommodate food goods of different dimensions and/or diameters. Additionally, the base 22 may act as a heatsink to transfer thermal energy away from the food goods stored within the storage cavity 30. Additional benefits or advantages of using this device may also be realized and/or achieved.

According to at least one aspect of the present disclosure, an appliance storage assembly includes a storage feature that includes a base and a plurality of walls that extend from the base. The base and the plurality of walls define a storage cavity. A rail assembly includes a rail and a rail slide. The rail slide is coupled to the storage feature and enables the storage feature to move along a length the rail. A divider includes an upper retaining member and a lower retaining member spaced-apart from one another by at least one connecting member. The upper retaining member defines upper grooves, and the lower retaining member defines corresponding lower grooves. A magnet is coupled to the lower retaining member and selectively engages the base of the storage feature.

According to another aspect, at least one connecting member includes a first connecting member that extends between first ends of upper and lower retaining members and a second connecting member that extends between second ends of the upper and lower retaining members.

According to yet another aspect, a base of a storage feature includes at least one magnetic member that magnetically engages a divider.

According to another aspect, a magnetic film is disposed on an upper surface of a base of a storage feature to magnetically engage a divider.

According to still another aspect, upper and lower grooves are defined on first and second sides of a divider. An apex of each of the upper grooves on the first side aligns with an apex of each of a corresponding upper groove on the second side.

According to yet another aspect, a lower retaining member defines a first width between corresponding apexes of the lower grooves and a second width between adjacent apexes. The second width is less than the first width.

According to another aspect, a magnet is disposed in a receiving cavity in a portion of a lower retaining member that defines a second width.

According to still another aspect, a divider is constructed of a thermally conductive material that acts as a heatsink that results in energy transfer from food goods disposed within a storage cavity to the thermally conductive material.

According to another aspect of the present disclosure, a storage assembly for an appliance includes a storage feature that has a plurality of walls that extend vertically from a metallic base. A rail assembly includes a rail slide slidably engaged with a rail. The rail slide is coupled to the storage feature. A divider includes an upper retaining member that defines a plurality of upper grooves and a lower retaining member that defines a plurality of lower grooves. At least one magnet is disposed within at least one receiving cavity defined in a lower surface of the lower retaining member and selectively engages the metallic base. A lower surface of the at least one magnet is flush with a lower surface of the lower retaining member.

According to another aspect, a plurality of upper grooves aligns with a plurality of lower grooves to define a plurality of receiving spaces.

According to yet another aspect, a plurality of upper grooves includes multiple first upper grooves defined on a first side of a divider and multiple second upper grooves defined on a second side of the divider.

According to still another aspect, a plurality of lower grooves includes multiple first lower grooves defined on the first side of the divider and multiple second lower grooves defined on the second side of the divider.

According to another aspect, at least one receiving cavity includes a first receiving cavity spaced-apart from a second receiving cavity. At least one magnet includes a first magnet disposed in the first receiving cavity and a second magnet disposed in the second receiving cavity.

According to yet another aspect, an internal flange extends around and connects an upper retaining member with first and second connecting members.

According to still another aspect, a first connecting member is substantially larger than a second connecting member.

According to another aspect of the present disclosure, an organizer for a storage assembly includes a divider that has an upper retaining member that defines a first upper groove and a second upper groove and a lower retaining member that defines a first lower groove and a second lower groove. The first and second upper grooves vertically align with the first and second lower grooves to define first and second receiving spaces. A magnet is coupled to the lower retaining member for selectively engaging the divider with the base.

According to another aspect, a lower retaining member defines a receiving cavity and a magnet is disposed within the receiving cavity.

According to still another aspect, a lower surface of a magnet is flush with a lower surface of a lower retaining member.

According to yet another aspect, first upper and lower grooves are defined in a first side of a divider and second upper and lower grooves are defined in a second side of the divider.

According to another aspect, upper and lower retaining members are spaced-apart from one another and coupled together via a connecting member.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance storage assembly, comprising:

a storage feature including a base and a plurality of walls extending from the base, wherein the base and the plurality of walls define a storage cavity;

a rail assembly including a rail and a rail slide, wherein the rail slide is coupled to the storage feature and enables the storage feature to move along a length the rail;

a divider including an upper retaining member spaced-apart from a lower retaining member by at least one connecting member, wherein the upper retaining member defines upper grooves and the lower retaining member defines corresponding lower grooves; and a magnet coupled to the lower retaining member and selectively engaging the base of the storage feature.

2. The appliance storage assembly of claim 1, wherein the at least one connecting member includes a first connecting member extending between first ends of the upper and lower retaining members and a second connecting member extending between second ends of the upper and lower retaining members.

3. The appliance storage assembly of claim 1, wherein the base of the storage feature includes at least one magnetic member that magnetically engages the divider.

4. The appliance storage assembly of claim 1, further comprising:

a magnetic film disposed on an upper surface of the base of the storage feature to magnetically engage the divider.

5. The appliance storage assembly of claim 1, wherein each of the upper and lower grooves are defined on first and second sides of the divider, and wherein an apex of each of the upper grooves on the first side aligns with an apex of a corresponding upper groove on the second side.

6. The appliance storage assembly of claim 5, wherein the lower retaining member defines a first width between corresponding apexes of the lower grooves and a second width between adjacent apexes, wherein the second width is less than the first width.

7. The appliance storage assembly of claim 6, wherein the magnet is disposed in a receiving cavity in a portion of the lower retaining member that defines the second width.

8. The appliance storage assembly of claim 1, wherein the divider is constructed of a thermally conductive material that acts as a heatsink that results in energy transfer from food goods disposed within the storage cavity to the thermally conductive material.

9. A storage assembly for an appliance, comprising:

a storage feature including a plurality of walls extending vertically from a metallic base;

a rail assembly including a rail slide slidably engaged with a rail, wherein the rail slide is coupled to the storage feature;

a divider including an upper retaining member defining a plurality of upper grooves and a lower retaining member defining a plurality of lower grooves; and at least one magnet disposed within at least one receiving cavity defined in a lower surface of the lower retaining member and selectively engaging the metallic base, wherein a lower surface of the at least one magnet is flush with a lower surface of the lower retaining member.

10. The storage assembly of claim 9, wherein the plurality of upper grooves align with the plurality of lower grooves to define a plurality of receiving spaces.

11. The storage assembly of claim 9, wherein the plurality of upper grooves includes multiple first upper grooves defined on a first side of the divider and multiple second upper grooves defined on a second side of the divider.

12. The storage assembly of claim 11, wherein the plurality of lower grooves includes multiple first lower grooves defined on the first side of the divider and multiple second lower grooves defined on the second side of the divider.

13. The storage assembly of claim 9, wherein the at least one receiving cavity includes a first receiving cavity spaced-apart from a second receiving cavity, and wherein the at least one magnet includes a first magnet disposed in the first receiving cavity and a second magnet disposed in the second receiving cavity.

14. The storage assembly of claim 9, further comprising:

an internal flange that extends around and connects the upper retaining member with first and second connecting members.

15. The storage assembly of claim 14, wherein the first connecting member is substantially larger than the second connecting member.

16. An organizer for a storage assembly, comprising:

a divider including an upper retaining member defining a first upper groove and a second upper groove and a lower retaining member defining a first lower groove and a second lower groove, wherein the first and second upper grooves vertically align with the first and second lower grooves to define first and second receiving spaces; and a magnet coupled to the lower retaining member for selectively engaging the divider with a base.

17. The organizer of claim 16, wherein the lower retaining member defines a receiving cavity and the magnet is disposed within the receiving cavity.

18. The organizer of claim 16, wherein a lower surface of the magnet is flush with a lower surface of the lower retaining member.

19. The organizer of claim 16, wherein the first upper and lower grooves are defined in a first side of the divider and the second upper and lower grooves are defined in a second side of the divider.

20. The organizer of claim 16, wherein the upper retaining member is spaced-apart from and coupled to the lower retaining member by a connecting member.

* * * * *